United States Patent [19]

Cavil et al.

[11] Patent Number: 4,559,017

[45] Date of Patent: Dec. 17, 1985

[54] CONSTANT VOLTAGE ANODE SYSTEM

[75] Inventors: David T. Cavil, Menomonee Falls; William R. Krueger, West Allis, both of Wis.

[73] Assignee: Outboard Marine Corporation, Waukegan, Ill.

[21] Appl. No.: 531,462

[22] Filed: Sep. 12, 1983

[51] Int. Cl.[4] ..... B63H 21/24

[52] U.S. Cl. ..... 440/76; 440/113; 204/147

[58] Field of Search ..... 204/147, 197, 196; 440/76, 900, 89, 88, 49, 113

[56] References Cited

U.S. PATENT DOCUMENTS

| | | | |
|---|---|---|---|
| 2,941,935 | 6/1960 | Miller et al. | 204/147 |
| 3,049,479 | 8/1962 | Preiser et al. | 204/147 |
| 3,477,931 | 11/1969 | Ueda et al. | 204/147 |
| 4,322,633 | 3/1982 | Staerzl | 204/147 |
| 4,407,711 | 10/1983 | Baboian et al. | 204/147 |

*Primary Examiner*—Trygve M. Blix
*Assistant Examiner*—Jesûs D. Sotelo
*Attorney, Agent, or Firm*—Michael, Best & Friedrich

[57] ABSTRACT

A marine propulsion unit having a housing exposed to sea water and subject to attack by the sea water is provided with a permanent type anode housing substantially constant surface characteristics mounted on the housing and supplied with constant voltage. Holes under the anode through the housing to interior passages permits the current on the anode to influence and protect the passages.

10 Claims, 4 Drawing Figures

Fig. 1
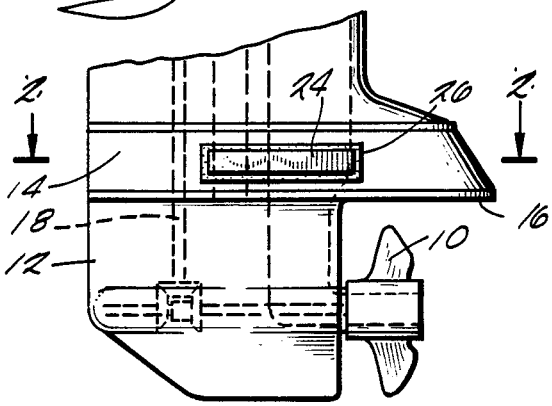
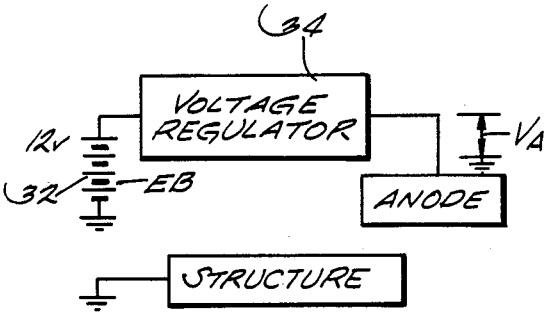
Fig. 3
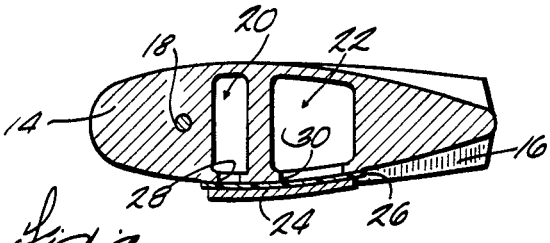
Fig. 2
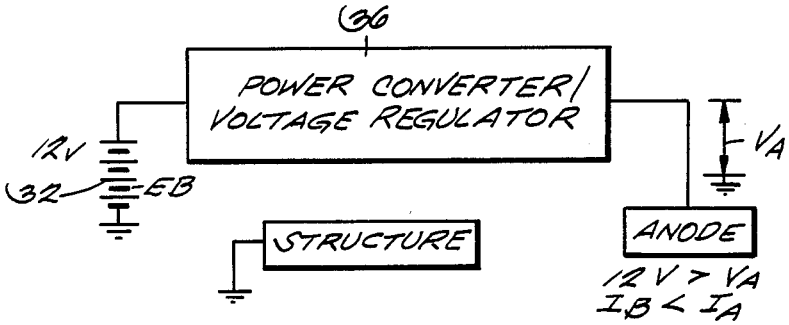
Fig. 4

CONSTANT VOLTAGE ANODE SYSTEM

FIELD OF THE INVENTION

This invention relates to cathodic protection systems for marine propulsion systems.

BACKGROUND OF THE INVENTION

Aluminum marine propulsion systems have been protected by sacrificial anodes (zinc, magnesium or certain alloys) which are dissolved in the course of time. They have also been protected by impressed current systems supplied by the boat battery. The latter systems use "permanent" anodes which are subject to surface passivation layers which radically alter the impedance of the anode surface to the sea water. This can result in the anode potential going above 1200 millivolts which leads to chemical attack of the aluminum. Therefore, a feedback circuit including a reference electrode, normally silver-silver chloride, is desireable.

The anode is normally mounted on the outside of the housing. Interior cavities in the lower housing of the motor have been unprotected.

Attention is directed to U.S. Pat. No. 3,477,931 which relates generally to a voltage control with various anode materials. It does not teach how to protect interior cavities.

SUMMARY OF THE INVENTION

An important feature of this invention is supplying a constant voltage to a permanent type of anode having substantially constant surface characteristics to protect an aluminum marine propulsion system.

Another important feature is mounting an anode on a marine propulsion unit over holes leading through the housing to the internal passages. With such an arrangement the inside as well as the outside is protected.

Still another feature is the protection of the housing of a marine propulsion system having apertures through the housing to inside passages or cavities by mounting an anode over the apertures so both the inside and outside of the housing are protected when a constant voltage is applied to the anode.

It may be noted that application of a constant voltage to an anode is electrically similar to a zinc sacrificial anode which is chemically attacked. The anode life and the voltage in the zinc caused by galvanic action in sea water varies with salinity. A zinc anode over apertures through the housing of the lower unit of the propulsion system could temporarily protect the inside and outside surfaces but would finally disappear leaving holes through the wall. If the inside cavity is part of the cooling water system, the hole would allow the cooling water pump to lose its prime and the engine would overheat and be ruined. With this in mind, it is apparent the anode should be a permanent anode wherever it is used in common to cavities or outside/inside surfaces which can't be connected without damage.

This invention is not limited to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

BRIEF DESCRIPTION OF THE DRAWINGS

FIG. 1 is a fragmentary side elevation of the lower portion of an outboard motor.

FIG. 2 is a section taken as indicated by line 2—2 in FIG. 1.

FIG. 3 is a schematic (block) diagram of one type of constant voltage circuit for the anode.

FIG. 4 is a schematic (block) diagram of another constant voltage circuit.

DETAILED DESCRIPTION OF THE DRAWINGS

FIG. 1 shows the lower portion of an outboard motor (or stern drive or other marine propulsion device). The propeller 10 projects from the lower gearcase 12 below the faired housing 14 and the anti-cavitation plate 16. The housing 14 encloses the drive shaft 18, a cooling water passage 20 and an exhaust passage 22.

Typically, the housing 14 and gearcase are made of aluminum alloy which is subject to corrosion in sea water. To protect the aluminum a carbon anode 24 is fixed to the housing with an insulator 26 between the housing and the anode to electrically insulate the anode from the housing. The anode and insulator may be glued or bolted to the housing. If bolted, the bolts must be insulated. The anode covers an aperture 28 to the cooling water passage and an aperture 30 to the exhaust passage. When the boat is at rest, sea water will rise above the anode in the passages. Therefore, the anode is effective to protect the aluminum walls of the passages as well as the outside of the lower unit.

The carbon anode is a permanent type anode which is not subject to surface passivation layers which, in turn, require a feedback circuit including a half-cell to prevent the protection level from becoming too high. Instead, the carbon anode has a surface not passivated or polarized permanently. Its surface impedance to the water remains very constant and predictable. Therefore, the anode can be operated from a constant voltage source without a half-cell reference electrode.

The constant voltage circuit of FIG. 3 can be used to provide a regulated voltage $V_A$ to the anode. The boat battery 32 supplies 12 V to the voltage regulator 34 whioh supplies a regulated voltage $V_A$ (somewhat less than 12 V) to the anode 24. The holes 28, 30 allow the anode current to be effective in the cavities 20, 22.

In FIG. 4 the battery supplies 12 V to the power converter/voltage regulator 36 to supply considerably less voltage $V_A$ to the anode. Since the converter/regulator is a power converter, the current $I_A$ supplied to the anode is higher than the current $I_B$ drawn from the battery. This arrangement greatly prolongs the battery life between charging. Further details of such a circuit may be seen in my copending application Ser. No. 531,420 filed Sept. 12, 1983. For the present invention it is sufficient to realize this is another constant voltage circuit which can be used.

Other anode material can be used. There is a ferrite material available from TDK Corporation and magnetite can also be used. There is a ferrite sprayed on titanium or niobium which is satisfactory. All these anodes can be operated at constant voltage, they will last the life of the marine propulsion system and, with the holes under the anode, will protect inside as well as outside.

We claim:

1. The combination with a marine drive unit having a lower housing exposed to sea water and having an internal passage also exposed to sea water, of means providing cathodic protection to said lower housing, comprising, an aperture between an outside surface of the housing and an inside surface of the passage, an anode mounted on one of the surfaces and exposed to the adjacent conditions and also exposed to the conditions adjacent the other surface.

2. The combination in accordance with claim 1 in which said anode is a permanent type of anode having constant surface characteristics, and including means impressing a constant voltage on said anode.

3. The combination in accordance with claim 2 in which there are multiple passages in said lower housing and there are apertures into each passage, said anode being mounted over each aperture.

4. The combination in accordance with claim 3 in which the anode has very constant surface characteristics, particularly constant surface impedance to water, and does not dissolve in sea water within the service life of the motor.

5. The combination in accordance with claim 4 in which the lower housing is an aluminum alloy.

6. The combination in accordance with claim 5 in which the anode is mounted on the outside of the lower housing and is insulated therefrom.

7. The combination in accordance with claim 6 in which the anode is carbon.

8. The combination in accordance with claim 6 in which the anode is ferrite.

9. The combination in accordance with claim 6 in which the anode is magnetile.

10. A marine drive unit comprising a housing exposed to sea water and subject to attack by the sea water, and including an internal passage, a permanent type anode having substantially constant surface characteristics mounted on the housing, said anode being mounted on and insulated from said housing in a position outside said passage, said housing being apertured so that said internal passage is exposed to said anode, and means for impressing a constant voltage on said anode.

* * * * *